US006748654B2

(12) United States Patent
Tomita et al.

(10) Patent No.: US 6,748,654 B2
(45) Date of Patent: Jun. 15, 2004

(54) METHOD OF MANUFACTURING SHOE FOR COMPRESSOR

(75) Inventors: Masanobu Tomita, Kariya (JP); Takamitsu Mukai, Kariya (JP); Yasuhiro Miura, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 24 days.

(21) Appl. No.: 10/171,155

(22) Filed: Jun. 13, 2002

(65) Prior Publication Data

US 2003/0014148 A1 Jan. 16, 2003

(30) Foreign Application Priority Data

Jun. 15, 2001 (JP) ..... 2001-181812

(51) Int. Cl.[7] ..... B23P 15/00
(52) U.S. Cl. ..... 29/888.02; 29/557; 72/356
(58) Field of Search ..... 29/888.02, 557; 72/356; 148/693

(56) References Cited

U.S. PATENT DOCUMENTS 4,512,175 A * 4/1985 Kaku et al. ..... 72/360
5,076,089 A * 12/1991 Takami ..... 72/356
5,950,480 A 9/1999 Fukushima ..... 72/336
2002/0166611 A1 * 11/2002 Sugiura et al. ..... 148/693
2002/0189316 A1 * 12/2002 Tomita et al. ..... 72/356
2003/0088979 A1 * 5/2003 Tomita et al. ..... 29/888.02

FOREIGN PATENT DOCUMENTS

EP 56136249 10/1981
JP 11-132143 5/1999

OTHER PUBLICATIONS

EP 02 01 3042 Search Report dated Oct. 6, 2003.

* cited by examiner

*Primary Examiner*—Irene Cuda Rosenbaum
(74) *Attorney, Agent, or Firm*—Woodcock Washburn LLP

(57) ABSTRACT

A cutting process S1 cuts a wire 1 into cut pieces each having a volume approximately equivalent to that of a desired shoe 11. A forging process S2 sequentially forges cut pieces 2 with forging dies 13, 23, and 33 having three cavities 13*c*, 23*d*, and 33*e* respectively, and obtains a steel sphere 8. A finishing process S3 obtains a shoe-shaped material 10 from the steel sphere 8 without a heat treatment, and carries out a heat treatment to the obtained material 10, thereby to obtain a shoe 11 for a compressor.

3 Claims, 8 Drawing Sheets

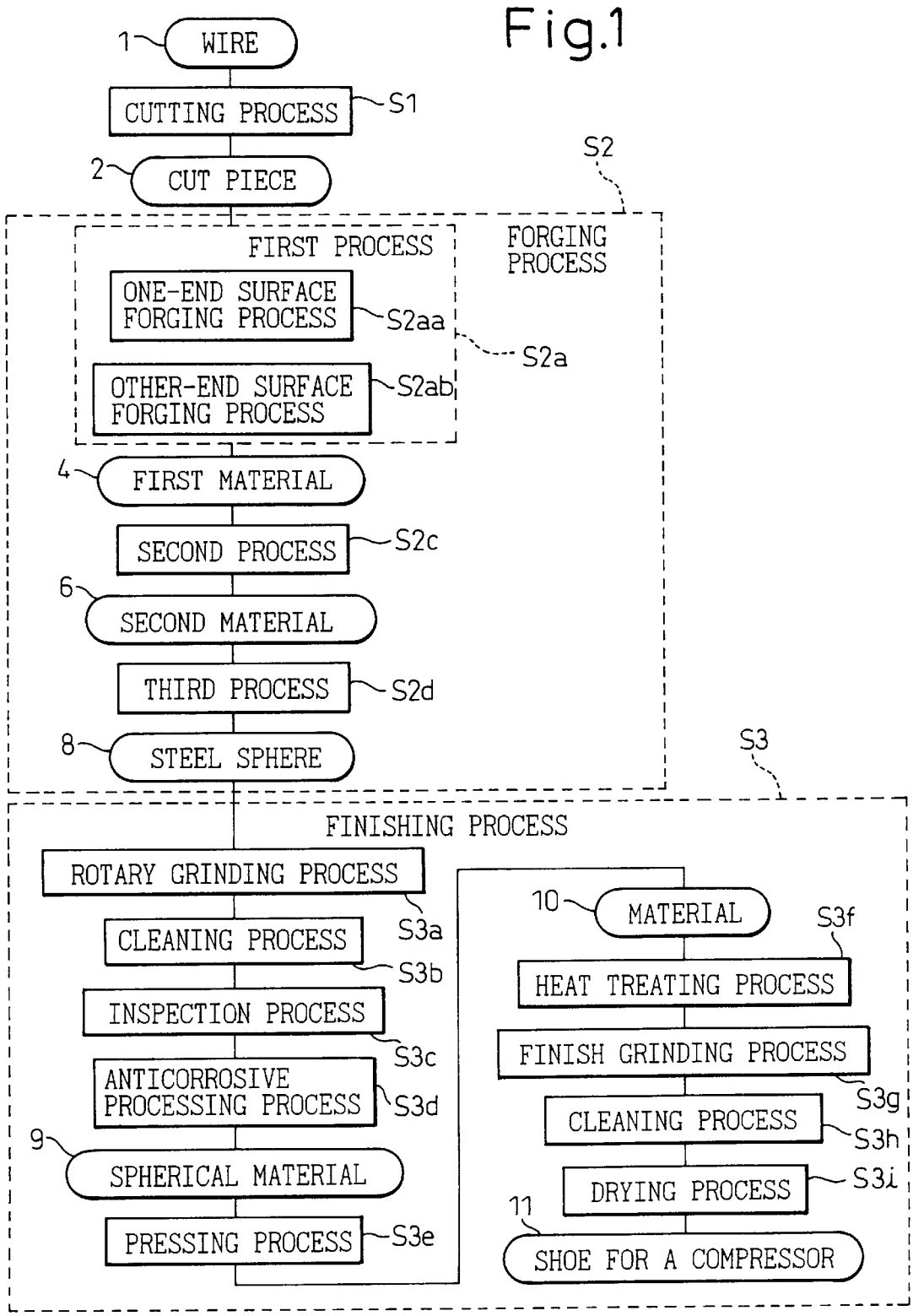
Fig.1
1
WIRE
CUTTING PROCESS
S1
2
CUT PIECE
S2
FORGING PROCESS
FIRST PROCESS
ONE-END SURFACE FORGING PROCESS
S2aa
S2a
OTHER-END SURFACE FORGING PROCESS
S2ab
4
FIRST MATERIAL
SECOND PROCESS
S2c
6
SECOND MATERIAL
THIRD PROCESS
S2d
8
STEEL SPHERE
S3
FINISHING PROCESS
ROTARY GRINDING PROCESS
S3a
CLEANING PROCESS
S3b
INSPECTION PROCESS
S3c
ANTICORROSIVE PROCESSING PROCESS
S3d
9
SPHERICAL MATERIAL
PRESSING PROCESS
S3e
10
MATERIAL
S3f
HEAT TREATING PROCESS
FINISH GRINDING PROCESS
S3g
CLEANING PROCESS
S3h
DRYING PROCESS
S3i
11
SHOE FOR A COMPRESSOR

METHOD OF MANUFACTURING SHOE FOR COMPRESSOR

BACKGROUND OF THE INVENTION

1. Field of the Invention

The present invention relates to a method of manufacturing a shoe for a compressor.

2. Description of the Related Art

A compressor, that compresses a refrigerant gas, is built into a refrigerating circuit that is used as a vehicle air conditioner or the like. For example, a known variable-displacement type swash-plate compressor has a plurality of cylinder bores 91*a* formed in a cylinder block 91, as shown in FIG. 10. A piston 92 is accommodated within each cylinder bore 91*a* so as to be able to carry out a reciprocating motion. Further, a swash plate 93 is supported by a drive shaft, not shown, such that the swash plate 93 is rotatable synchronously with the drive shaft and is tiltable with respect to the drive shaft. A pair of shoes 94 are provided, on each side of the swash plate 93, between the swash plate 93 and each piston 92. As shown in FIG. 11, the upper surface of each shoe 94 forms a part of a spherical surface as a spherical surface portion 94*a*, and the lower surface of the shoe forms approximately a plane surface as a plane surface portion 94*b*. A cylindrical portion 94*c* is formed in the middle between the upper portion and the lower portion via a round portion R.

In a compressor having the above structure, the swash plate 93 rotates synchronously with the drive shaft and makes an inclined movement with respect to the drive shaft, and a rotary motion of the swash plate 93 is converted into a linear reciprocating motion of the piston 92 within the cylinder bore 91*a* via the shoes 94, based on the rotation of the drive shaft, as shown in FIG. 10. A suction, a compression, and a discharging of a refrigerant gas are carried out at the head end of the piston 92, based on these motions. During this period, the spherical surface portion 94*a* of each shoe 94 slides on the surface of a spherical surface seat 92*a* of the piston 92, and the plane surface portion 94*b* of the shoe slides on the surface of the swash plate 93. Therefore, the shoe 94 is required to have high size precision and small surface roughness in order to allow smooth sliding.

Conventionally, a shoe 94 has been manufactured according to a cutting process, a forging process, and a finishing process, as follows.

<Cutting Process>

As shown in FIG. 12, a wire 70 prepared from SUJ2 (JIS Japanese Industry Standard G4805) as a high carbon chrome bearing steel is provided first. This wire 70 is cut into pieces to obtain cut pieces 71 in a cutting process S90.

<Forging Process>

Next, in a forging process S91, each cut piece 71 is forged with a lower die 95*a* and an upper die 95*b*, by using a forging die 95 that has a single cavity 95*c* to form a sphere as shown in FIG. 13. As a result, an approximately spherical steel sphere 72 having a slight flash 72*a* is obtained as shown in FIG. 14.

<Finishing Process>

Then, the following finishing process S92 is carried out as shown in FIG. 12. First, in a flash removing (deburring) process S92*a*, a flash (a burr) is removed by sandwiching the steel sphere 72 between two rotary casting boards, not shown, and by rotating the casting boards, thereby to obtain a flash-removed ball 73.

Next, in a heat treating process S92*b*, a hardening and a tempering are carried out to obtain a heat-treated ball 74.

In a grinding process S92*c*, the heat-treated ball 74 is ground with a casting board similar to that explained above and is ground with a grindstone, thereby to obtain a ground ball 75. The hard ground ball 75 obtained in this way can also be used as a ball of a rolling bearing.

Further, the ground ball 75 is annealed in an annealing process S92*d*, thereby to obtain an annealed ball 76 that has a slightly lower hardness than that of the ground ball 75 and that has any internal distortion removed.

Then, in a rotary grinding process S92*e*, the annealed balls 76 and a slurry are put into a rotary grinder not shown, and are rotated together. As a result, the annealed balls 76 are brought into contact with each other, and are mutually ground. Gloss is added to these balls, and stains adhered to the surfaces of these balls are removed.

Further, in a cleaning process S92*f*, an ultrasonic cleaning is carried out to remove slight stains adhered to the surfaces. A visual inspection process S92*g* is carried out, and an anticorrosive is coated onto the balls in an anticorrosive processing process S92*h*. As a result, a raw ball 77 having a true spherical shape is obtained.

In a pressing process S92*i*, the raw ball 77 is pressed to obtain a material 78 formed in a shoe shape.

Further, in a heat treating process S92*j*, a hardening and a tempering are carried out. Then, the shoe-shaped material is ground to obtain a shoe shape and a surface coarseness within a standard, in a finish grinding process S92*k*. The shoe-shaped material is further cleaned in a cleaning process S92*l*, and is dried in a drying process S92*m* to finally obtain a shoe 94 for a compressor.

The conventional manufacturing method employs the flash removing process S92*a*. Therefore, the grinding process S92*c* and the rotary grinding process S92*e* are necessary. As the steel sphere 72 is obtained in one process of the forging process S91 by using the forging die 95 consisting of the lower die 95*a* and the upper die 95*b*, it is difficult to obtain a desired shape. Therefore, the cut piece 71 having a slightly larger volume than that of a desired shoe is obtained. This cut piece 71 has a flash (burr) 72*a*. As a slight gap is formed between the upper die 95*b* and the lower die 95*a* of the forging die 95, the flash 72*a* occurs in this gap. The obtained steel sphere 72 having the flash 72*a* is further subjected to the flash removing process S92*a*, the grinding process S92*c*, and the rotary grinding process S92*e*. Based on these processes, dispersion in the volume of the raw ball 77 is eliminated. The raw ball 77 that has approximately the same volume as that of the desired shoe 94 is pressed in the pressing process S92*i*. As a result, the shoe-shaped material 78 also has a constant volume, and the finally-obtained shoe 94 for a compressor has high size precision. The obtained shoe 94 has small surface roughness after the heat treating process S92*j* and the finish grinding process S92*k*.

According to the above conventional manufacturing method, however, the shoe 94 is manufactured from the raw ball 77, after the raw ball 77 has been manufactured.

In other words, according to the conventional manufacturing method, the steel sphere 72 after the forging process S91 is further subjected to many processes including the flash removing process S92*a*, the heat treating process S92*b*, the grinding process S92*c*, the annealing process S92*d*, and the rotary grinding process S92*e*. The raw ball 77 is completed through the above processes. Thereafter, the raw ball 77 is again subjected to the pressing process S92*i* that deforms the raw ball 77 to obtain the material 78. This material 78 is then subjected to the heat treating process S92*j*, and the finish grinding process S92*k*. Therefore, an extremely large number of processes are carried out on the wire 70. Consequently, the process takes a long time, and is expensive.

SUMMARY OF THE INVENTION

The present invention has been made in the light of the above problems. It is, therefore, an object of the present invention to provide a method of manufacturing a shoe for a compressor that can shorten the manufacturing time and can reduce the manufacturing cost.

In order to achieve the above object, according to a first aspect of the present invention, there is provided a method of manufacturing a shoe for a compressor comprising: a cutting process that cuts a steel wire to obtain cut pieces; a forging process that forges each cut piece to obtain a steel sphere; and a finishing process that obtains a shoe for a compressor from the steel sphere, wherein the cutting process cuts the wire into cut pieces each having a volume approximately equivalent to that of a desired shoe, the forging process sequentially forges the cut pieces with forging dies having three or more cavities, and the finishing process obtains a shoe-shaped material from the steel sphere without a heat treatment, and carries out at least a heat treatment on the obtained material, thereby to obtain the shoe for a compressor.

According to the above aspect of the invention, in the method of manufacturing a shoe for a compressor, the cutting process cuts a wire into cut pieces each having a volume approximately equivalent to that of a desired shoe. Therefore, the steel sphere obtained in this forging process does not have a surplus portion such as a flash. Further, according to this manufacturing method, the forging process sequentially forges the cut pieces with forging dies having three or more cavities. Therefore, there occurs small distortion in the cut pieces in each step of the forging process, and there is smaller occurrence of a flash. Therefore, the conventional flash removing process becomes unnecessary.

Further, according to this manufacturing method, the finishing process does not include a heat treatment processing in the step of obtaining the shoe-shaped material from the steel sphere. Therefore, the heat treating process that has been conventionally carried out on the steel sphere becomes unnecessary. The grinding process after this heat treating process also becomes unnecessary, if this heat treatment has been conventionally carried out in the oxygen atmosphere. As it is possible to omit the conventional heat treating process and omit the subsequent grinding process, the conventional annealing process also becomes unnecessary. At least, a heat treatment is carried out to the material obtained in this way, and a shoe for a compressor is obtained as a result. Therefore, it is possible to obtain a shoe based on a small number of processes that are carried out to the wire. Facilities for the processes, that can be omitted, and consumable supplies also become unnecessary.

Therefore, according to this manufacturing method, it is possible to shorten the manufacturing time, and it is also possible to reduce the manufacturing cost. As the number of processes is decreased, it is also possible to prevent wastage of energy.

Further, according to a second aspect of the present invention, the above forging process comprises: a first process that provides a first material by forming a continuous curved surface on both end surfaces and a peripheral surface of each cut piece; a second process that provides a second material by forming the first material into a barrel-shaped second material; and a third process that forms the second material into a steel sphere having an approximately spherical shape. According to tests carried out by the inventors of the present invention, no flash occurs on the steel sphere at all.

Further, according to a third aspect of the present invention, the above first process comprises: a one-end surface forging process that provides the first material by forming a continuous curved surface on one end surface and a peripheral surface of each cut piece; and an other-end surface forging process that provides the first material by forming a continuous curved surface on the other end surface and a peripheral surface of each cut piece, wherein the one-end surface forging process and the other-end surface forging process use a cavity of the same forging die. In this case, after the one-end surface forging process has been carried out to one cut piece, this cut piece is reversed and the other-end surface forging process is carried out to this cut piece. The first process has been completed in this way. Based on this arrangement, it becomes possible to form a continuous curved surface on one end surface, the other end surface and the peripheral surface of each cut piece, by using the cavity of the same forging die. Therefore, it becomes easy to manufacture the forging die. As a result, the manufacturing cost of the forging die becomes low, and the manufacturing cost of the shoe accordingly becomes low.

The present invention may be more fully understood from the description of the preferred embodiments of the invention, as set forth below, together with the accompanying drawings.

BRIEF DESCRIPTION OF THE DRAWINGS

FIG. 1 is a process diagram according to an embodiment.

DESCRIPTION OF THE PREFERRED EMBODIMENTS

An embodiment of the present invention and a comparative example will be explained below with reference to the drawings.

Embodiment

<Cutting Process>

Figure 2:
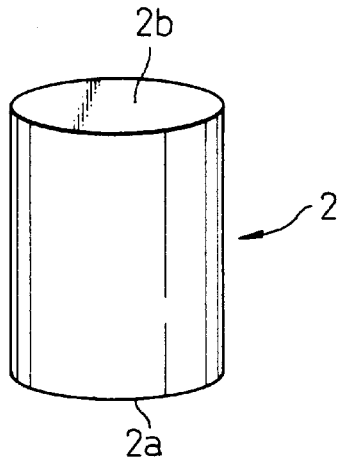
FIG. 2 is a perspective view of a cut piece.

According to a method of manufacturing a shoe for a compressor in the embodiment, a wire 1 prepared from an SUJ2 (JIS G4805) as a high carbon chrome bearing steel is provided first, as shown in FIG. 1. A cutting process S1 is carried out to cut the wire 1 into cut pieces 2 each having a volume approximately equivalent to that of a desired shoe 11. In this way, a cylindrical cut piece 2 having one end surface 2*a* and the other end surface 2*b* is obtained, as shown in FIG. 2.

<Forging Process>

Figure 3:
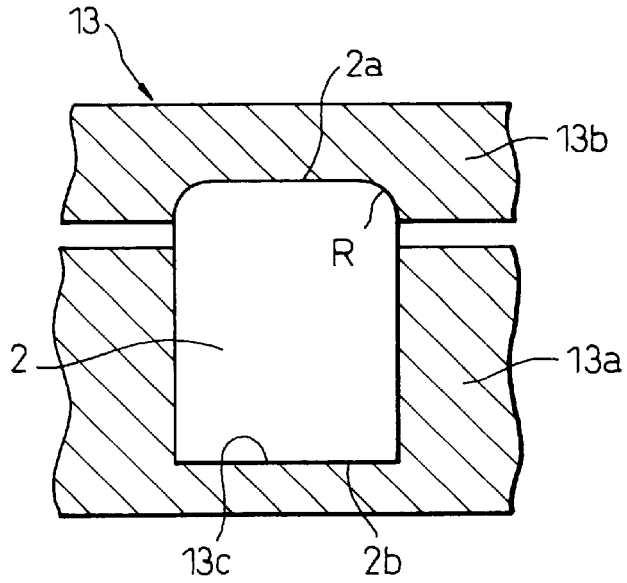
FIG. 3 is a partial cross sectional view of a forging die in a state that a cut piece is inserted into this die.
Figure 5:
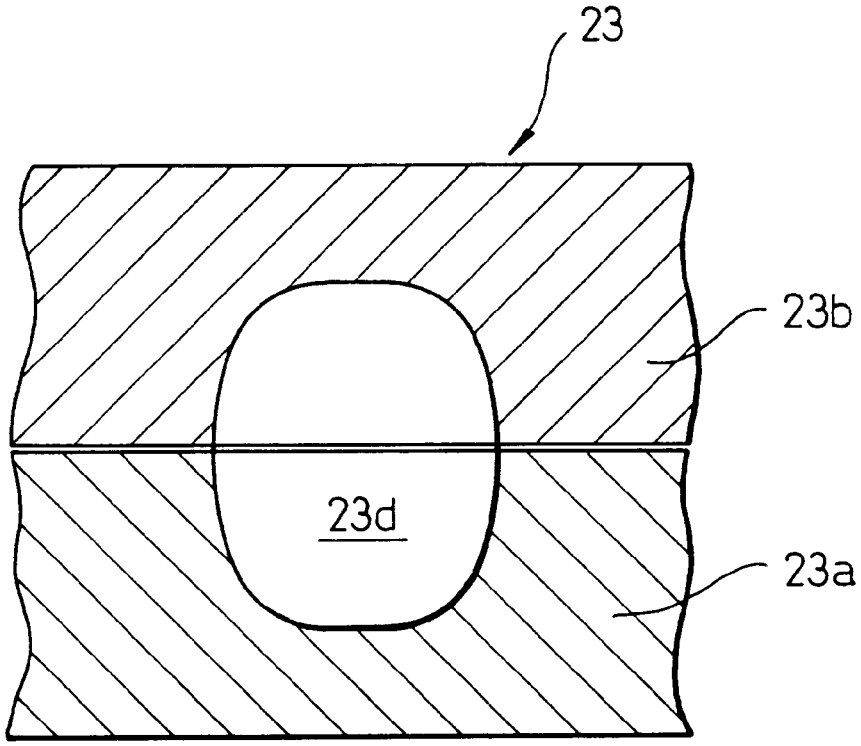
FIG. 5 is a partial cross sectional view of a forging die.
Figure 7:
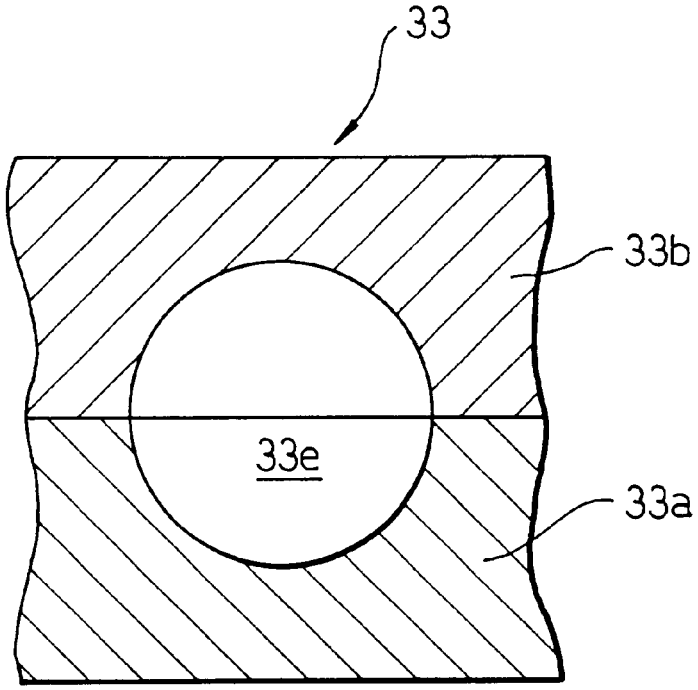
FIG. 7 is a partial cross sectional view of a forging die.

Next, a forging process S2 shown in FIG. 1 is carried out. Three forging dies 13, 23, and 33 as shown in FIG. 3, FIG. 5, and FIG. 7 respectively are prepared, for this purpose. These forging dies 13, 23, and 33 have lower dies 13*a*, 23*a*, and 33*a*, and upper dies 13*b*, 23*b*, and 33*b* that can move relative to the lower dies 13*a*, 23*a*, and 33*a*, respectively. The lower dies 13*a*, 23*a*, and 33*a*, and the upper dies 13*b*, 23*b*, and 33*b* have cavities 13*c*, 23*d*, and 33*e*, respectively.

First, in a one-end surface forging process S2*aa* of a first process S2*a* shown in FIG. 1, the forging die 13 shown in FIG. 3 forms the cavity 13*c* with the lower die 13*a* that defines the other end surface 2*b* and a peripheral surface, and the upper die 13*b* that defines one end surface 2*a*. When the cut piece 2 is forged within this cavity 13*c*, one end surface 2*a* and the peripheral surface of the cut piece 2 continue in a curved surface, and one end surface 2*a* of this cut piece 2 is rounded as a round portion R. In this case, the role of the upper die 13*b* is to form a curve on one end surface 23*a* of the cut surface 2. Therefore, it is not necessary that the upper die 13*b* comes extremely close to the lower die 13*a* to be connected.

Figure 4:
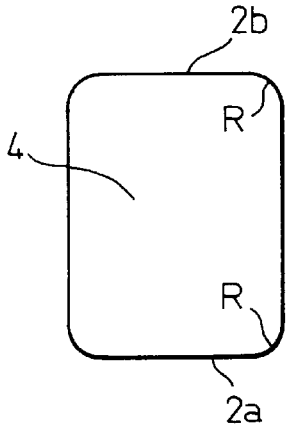
FIG. 4 is a side view of a first material.

Next, in an other-end surface forging process S2*ab* of the first process S2*a* shown in FIG. 1, the cut piece 2 of which one end surface 2*a* has been rounded as a round portion R is reversed. Then, the other end surface 2*b* is forged in the same cavity 13*c* of the same forging die 13. In this case, it is also possible to form a curved surface without bringing the upper die 13*b* extremely close to the lower die 13*a*. The periphery of the other end surface 2*b* is rounded in a similar manner. The process 2*a* has been completed in this way. As a result, a first material 4, having the first end surface 2*a* and the other end surface 2*b* rounded as round portions R, respectively, is obtained as shown in FIG. 1 and FIG. 4.

Figure 6:
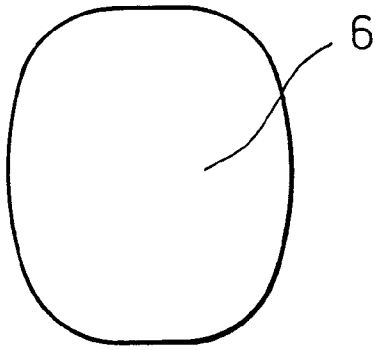
FIG. 6 is a side view of a second material.

In a second process S2*c* shown in FIG. 1, the first material 4 is forged in the forging die 23 having the cavity 23*d* in a barrel shape, that is, a swollen shape of the peripheral surface at the center, as shown in FIG. 5. As a result, a barrel-shaped second material 6 is obtained as shown in FIG. 6. In this case, it is preferable that the cavity 23*d* has a volume strictly equivalent to or slightly larger than the capacity of the desired shoe 11. The upper die 23*b* and the lower die 23*a* that constitute the forging die 23 cannot form a precisely smooth connection between them, and a slight gap is formed between these dies. Therefore, it is preferable to avoid factors which generate a flash (burr) in this gap due to the swelling. No flash occurs on the peripheral surface of the barrel-shaped second material that has a shape close to a spherical shape.

Figure 8:
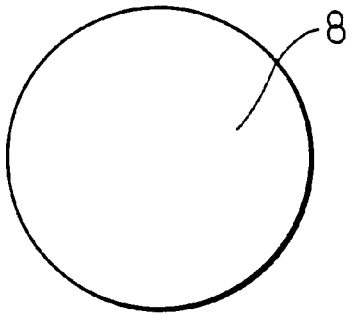
FIG. 8 is a side view of a steel sphere.

In a third process S2*d* shown in FIG. 1, the barrel-shaped second material 6 is forged in the forging die 33 having the spherical cavity 33*e*, as shown in FIG. 7. As a result, a steel sphere 8 having an approximately spherical shape is obtained as shown in FIG. 8. The forging process S2 is completed in this way. In this case, it is also preferable that the cavity 33*e* has a volume strictly equivalent to or slightly larger than the capacity of the desired shoe 11. As the second material 6 having a barrel shape is changed into the material having an approximately spherical shape, the quantity of deformation is small. Consequently, factors which generate flash become smaller. A flash does not occur on the steel sphere 8, except an extremely small belt-shaped recess at the center.

<Finishing Process>

In a finishing process S3, the following processes are carried out, as shown in FIG. 1.

First, in a rotary grinding process S3*a*, the steel spheres 8 and a slurry are put into a rotary grinder, not shown, and are rotated together. As a result, the steel spheres 8 are brought into contact with each other, and are mutually ground. Gloss is added to these spheres, and stains adhered to the surfaces of these spheres are removed.

Further, in an ultrasonic cleaning process S3*b*, an ultrasonic cleaning is carried out to remove slight stains adhered to the surfaces of the spheres. A visual inspection process S3*c* is carried out, and an anticorrosive is coated onto the spheres, in an anticorrosive processing process S3*d*. As a result, a spherical material 9 is obtained.

Figure 9:
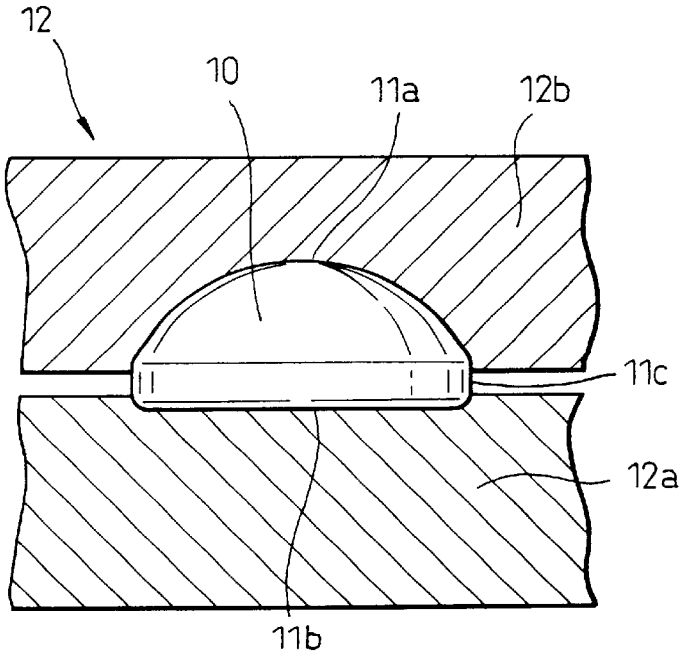
FIG. 9 is a partial cross sectional view of a pressing die that forms a steel sphere into a shoe-shaped material.
Figure 10:
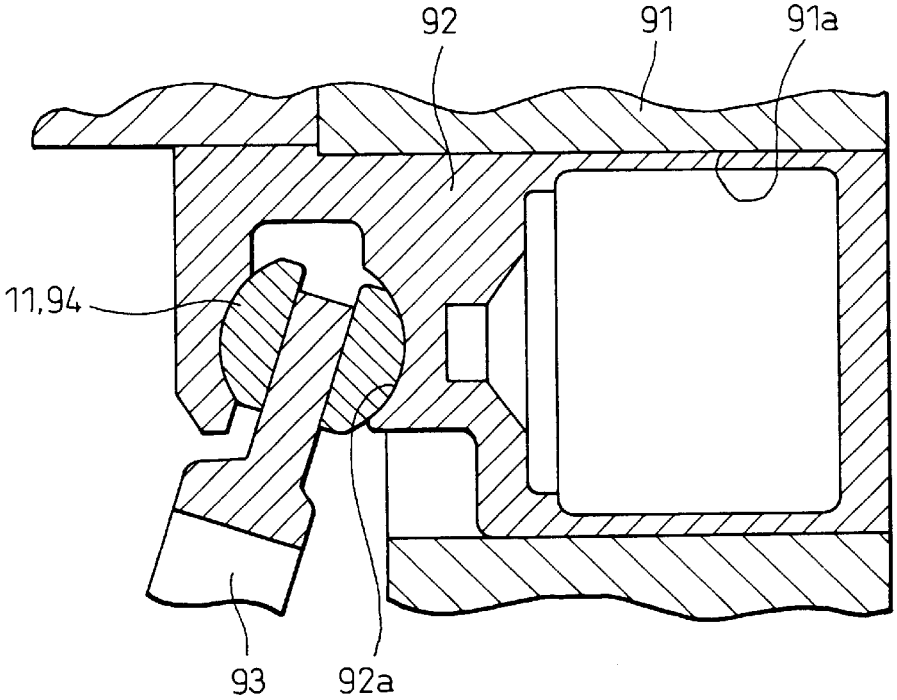
FIG. 10 is a cross sectional view of a main part of a compressor built in with a shoe according to the embodiment and a comparative example.
Figure 11:
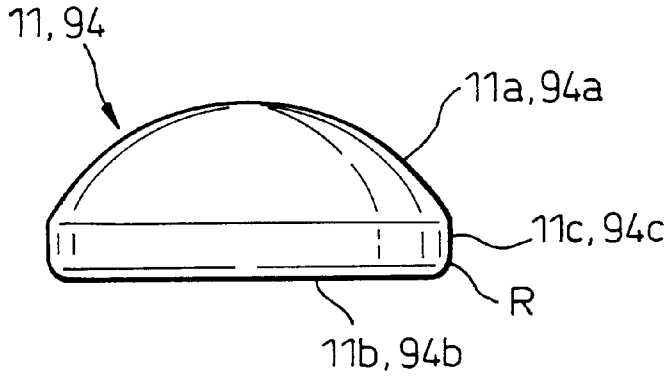
FIG. 11 is a side view of a shoe according to the embodiment and the comparative example.

In a pressing process S3*e*, the spherical material 9 is pressed to obtain a material 10 formed in a shoe shape. In other words, the spherical material 9 is pressed with a lower die 12*a* and an upper die 12*b* that constitute a pressing die 12, as shown in FIG. 9. In this case, the upper die 12*b*, that forms a portion corresponding to a spherical surface portion 11*a* of the shoe 11, and a lower die 12*a*, that forms a portion corresponding to a plane surface portion 11*b*, are separated. Even when an extremely small belt-shaped recess occurs on the steel sphere 8, this recess is formed on a cylindrical shape portion 11*c* between the spherical surface portion 11*a* and the plane surface portion 11*b*. Therefore, after the steel sphere 8 has been built into a compressor, this does not become a sliding portion that slides on the spherical surface seat 92*a* of the piston 92 or on the swash plate 93, as explained above. Therefore, this portion does not influence the sliding.

Further, the shoe-shaped material 10 is hardened and tempered in a heat treating process S3*f*. Then, a finish grinding process S3*g*, a cleaning process S3*h*, and a drying process S3*i* are carried out. As a result, the shoe 11 for a compressor is obtained.

Comparative Example

Figure 12:
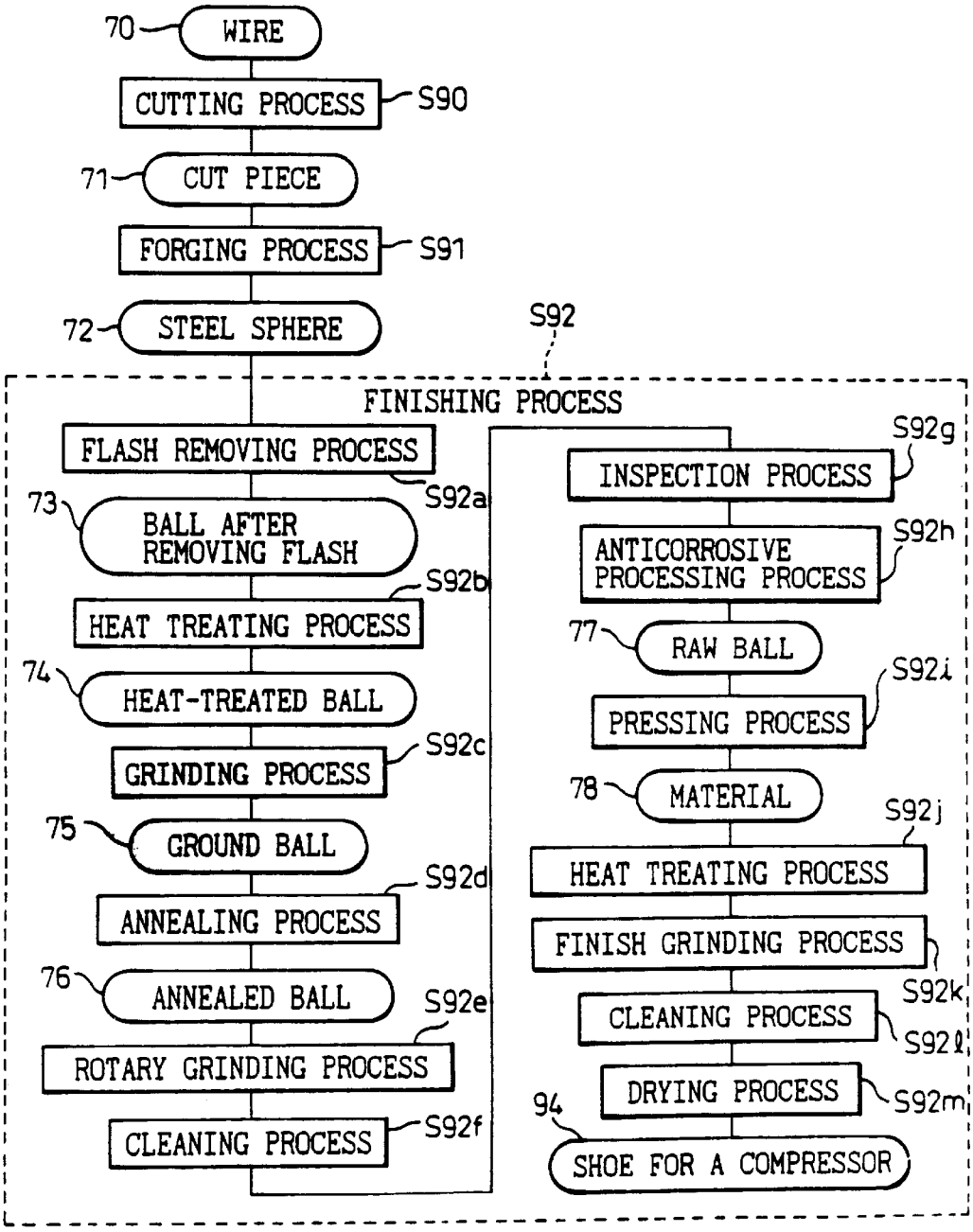
Fig.12 (Prior Art)
FIG. 12 is a process diagram according to a conventional example and the comparative example.
Figure 13:
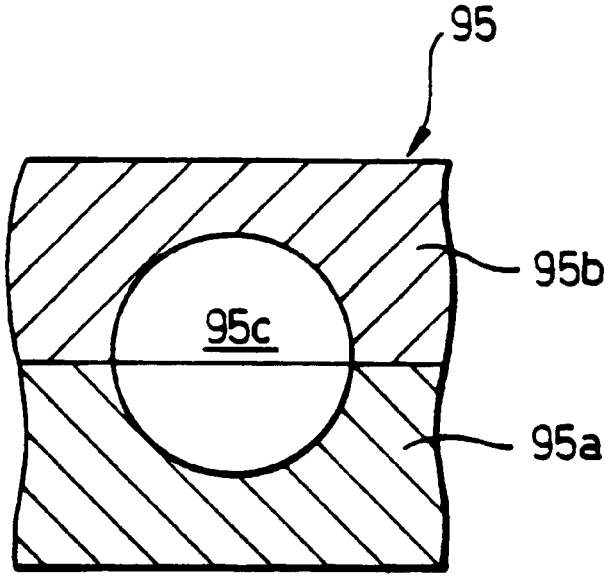
Fig.13 (Prior Art)
FIG. 13 is a partial cross sectional view of a forging die according to the conventional example and the comparative example.
Figure 14:
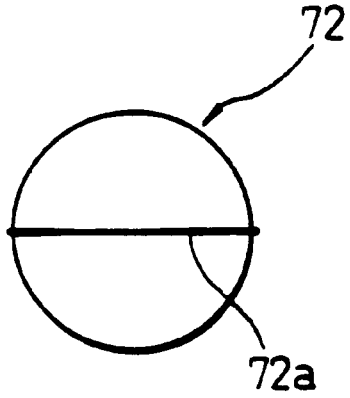
Fig.14 (Prior Art)
FIG. 14 is a side view of a steel sphere according to the conventional example and the comparative example.

In a manufacturing method of the comparative example, a shoe 94 for a compressor is obtained by employing the conventional method of manufacturing a shoe for a compressor shown in FIG. 12.

The manufacturing method of the embodiment can be compared with that of the comparative example, and the shoes 11 and 94 obtained from these manufacturing methods can be compared with each other as follows. According to the manufacturing method of the embodiment, the wire 1 is cut into cut pieces 2 each having a volume approximately equivalent to that of the desired shoe 11, in the cutting process S1. Therefore, a surplus portion like a flash is not easily generated on the steel sphere 8 obtained in the forging process S2. Particularly, according to the method of the embodiment, there are used the forging dies 13, 23, and 33 that have the three cavities 13*c*, 23*d*, and 33*e* respectively. The steel sphere 8 is manufactured in the forging process S2 at the four stages. The flash 72*a* does not occur on this steel sphere 8, although the flash 72*a* is recognized on the steel sphere 72 manufactured from the forging die 95 having only one cavity 95*c* in the comparative example. Therefore, although the flash removing (deburring) process and the grinding process are not carried out to the spherical material 9 in the embodiment, it is possible for the spherical material 9 to have the volume that is required to manufacture the shoe 94 of the comparative example.

Further, according to the manufacturing process of the embodiment, it is possible to obtain the shoe 11 by carrying out a smaller number of processes to the wire 1, as the heat treating process and the annealing process are not carried out, unlike the comparative example. Further, the facilities for the processes, that can be omitted, and consumable supplies also become unnecessary. Therefore, it is possible to shorten the manufacturing time, and it is also possible to reduce the manufacturing cost. As the number of processes is decreased, it is also possible to prevent wastage of energy.

According to the embodiment, the forging process S2 is carried out by using the forging dies 13, 23, and 33 having the three cavities 13*c*, 23*d*, and 33*e* respectively. Instead of the above, it is also possible to carry out a process using a separate forging die having a separate cavity, between the second process S2*c* of obtaining the barrel-shaped second material 6 and the third process S3*d* of obtaining the steel sphere 8. Based on this, it is possible to form the barrel-shaped material into a material of a shape closer to the spherical shape. As a result, it becomes possible to further minimize the quantity of deformation when the steel sphere 8 is forged.

While the invention has been described by reference to a specific embodiment chosen for the purpose of illustration, it will be apparent that numerous other modifications could be made thereto, by those skilled in the art, without departing from the basic concept and scope of the invention.

What is claimed is:

1. A method of manufacturing a shoe for a compressor comprising:

a cutting process that cuts a steel wire to obtain cut pieces;

a forging process that forges each cut piece to obtain a steel sphere; and a finishing process that obtains the shoe for a compressor from the steel sphere, wherein the cutting process cuts the wire into cut pieces each having a volume approximately equivalent to that of a desired shoe, the forging process sequentially forges the cut pieces with forging dies having three or more cavities, and the finishing process obtains a shoe-shaped material from the steel sphere without heat treatment, and carries out at least a heat treatment on the shoe-shaped material, to thereby obtain the shoe for a compressor.

2. The method of manufacturing a shoe for a compressor according to claim 1, wherein the forging process comprises: a first process that provides a first material by forming a continuous curved surface on both end surfaces and a peripheral surface of each cut piece; a second process that provides a second material by forming the first material into a barrel-shaped second material; and a third process that forms the second material into a steel sphere having approximately a spherical shape.

3. The method of manufacturing a shoe for a compressor according to claim 2, wherein the first process comprises: a one-end surface forging process that provides the first material by forming a continuous curved surface on one end surface and a peripheral surface of each cut piece; and an other-end surface forging process that provides the first material by forming a continuous curved surface on the other end surface and a peripheral surface of each cut piece, wherein the one-end surface forging process and the other-end surface forging process use a cavity of the same forging die.

* * * * *